US005910059A

United States Patent [19]

Hanson

[11] Patent Number: 5,910,059

[45] Date of Patent: Jun. 8, 1999

[54] GAME APPARATUS

[76] Inventor: Thomas E. Hanson, 24041 Farmington Rd., Farmington, Mich. 48336

[21] Appl. No.: 08/987,522

[22] Filed: Dec. 9, 1997

[51] Int. Cl.[6] ..... A63B 37/02

[52] U.S. Cl. ..... 473/594

[58] Field of Search ..... 473/594, 597, 473/598, 599, 603, 604, 607, 608, 577

[56] References Cited

U.S. PATENT DOCUMENTS

| | | | |
|---|---|---|---|
| 1,556,099 | 10/1925 | Gilson | 473/598 |
| 1,669,198 | 5/1928 | Greer . | |
| 3,937,470 | 2/1976 | Stalberger, Jr. et al. | 473/594 |
| 4,151,994 | 5/1979 | Stalberger, Jr. | 473/594 |
| 4,354,679 | 10/1982 | Steinmetz | 473/594 |
| 4,943,066 | 7/1990 | Lathim et al. | 473/594 |
| 5,056,795 | 10/1991 | Buhrow . | |
| 5,429,351 | 7/1995 | Hanson | 473/594 |
| 5,566,953 | 10/1996 | Arriola et al. | 473/594 |

*Primary Examiner*—Steven Wong
*Attorney, Agent, or Firm*—Chase & Yakimo, L.C.

[57] ABSTRACT

A hand bag for striking by a back of a game player's hand comprises a plurality of panels first stitched together to form first and second panels that are then stitched about their periphery. The hand bag contains disk-shaped fluid pellets of a high density polyethylene material therein or a gel therein. The ellipsoid-shaped filler pellets are contained within an inner lining for insertion into the hand bag during assembly. Lacing extends about the stitched periphery to further secure the panels while protecting the initial stitching. The plurality of panels with lines of flexion therebetween are configured to complement the back of the user's hand so that upon striking an improved lift and airborne flight is imparted to the hand bag.

18 Claims, 7 Drawing Sheets

GAME APPARATUS

BACKGROUND OF THE INVENTION

This invention relates to a hand bag for a game use and, more particularly, to an improved device designed to be kept aloft with lift afforded by the back of the game player's hands during game play.

The use of objects in various games which are to be kept in the air is well known. Game devices such as Frisbees®, Hacky Sacks®, balls, etc. are utilized with various types of game rules, if any, so as to provide enjoyment to the game players.

Such games and devices employed therein are known to assist in the development of one's eye/foot and eye/hand coordination. In my U.S. Pat. No. 5,429,351, a game device was disclosed which is kept aloft by the back of the game player's hand. I have improved the device's configuration so as to provide optimum efficiency when contacting the back of the game player's hand.

In response thereto, I have invented an improved device designed for airborne movement in connection with various types of game rules, herein referred to as a "hand bag" for purposes of description and not limitation. The hand bag is kept aloft by offering lift thereto with the back of one's hand. The shape and structure of this hand bag and the filler material within the hand bag allow for more efficient contact with the back of the hand when properly struck so as to increase the efficacy of the hand bag in game use and the subsequent user enjoyment offered thereby. Also, the method of assembling the hand bag provides for efficient insertion of a filler material.

The preferred embodiment of the invention generally presents a device gradually disk-like in configuration having a plurality of panels secured together by stitching and exterior leather lacing so as to maintain the integrity of the hand bag during use and to promote efficient contact with the back of the hand. The device is preferably made of a garment suede leather with the filler material being made by an "underwater pelletized" method and contained within an inner liner or pouch. The filler pellets are disk-shaped so as to efficiently slide over each other when the hand bag is compressed. It has been discovered that ellipsoid-shaped pellets provide more efficient sliding than any other pellet shape (e.g., cylindrical, spherical, or irregular). In another embodiment, the filler material may be a resilient gel-like substance injected into a bladder within the device and having a fluidity similar to the disk-shaped pellets.

It is therefore a general object of the invention to provide a hand bag for use as an airborne device in various games of play.

Another general object of the invention is to provide a hand bag, as aforesaid, which is kept aloft during game play by lift offered by the back of the hand of the game player.

A further object of the invention is to provide a hand bag, as aforesaid, which is utilized in various games for the development of skills transferrable to other sports.

A particular object of this invention is to provide a hand bag, as aforesaid, which presents a structure adapted for efficient lift upon proper contact with the back of the hand during game play.

Still another particular object of this invention is to provide a handbag, as aforesaid, which presents a structure for efficient contact by the back of the hand of the game player.

Yet another object of the invention is to provide a hand bag, as aforesaid, which presents a structure for efficient insertion of filler material.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
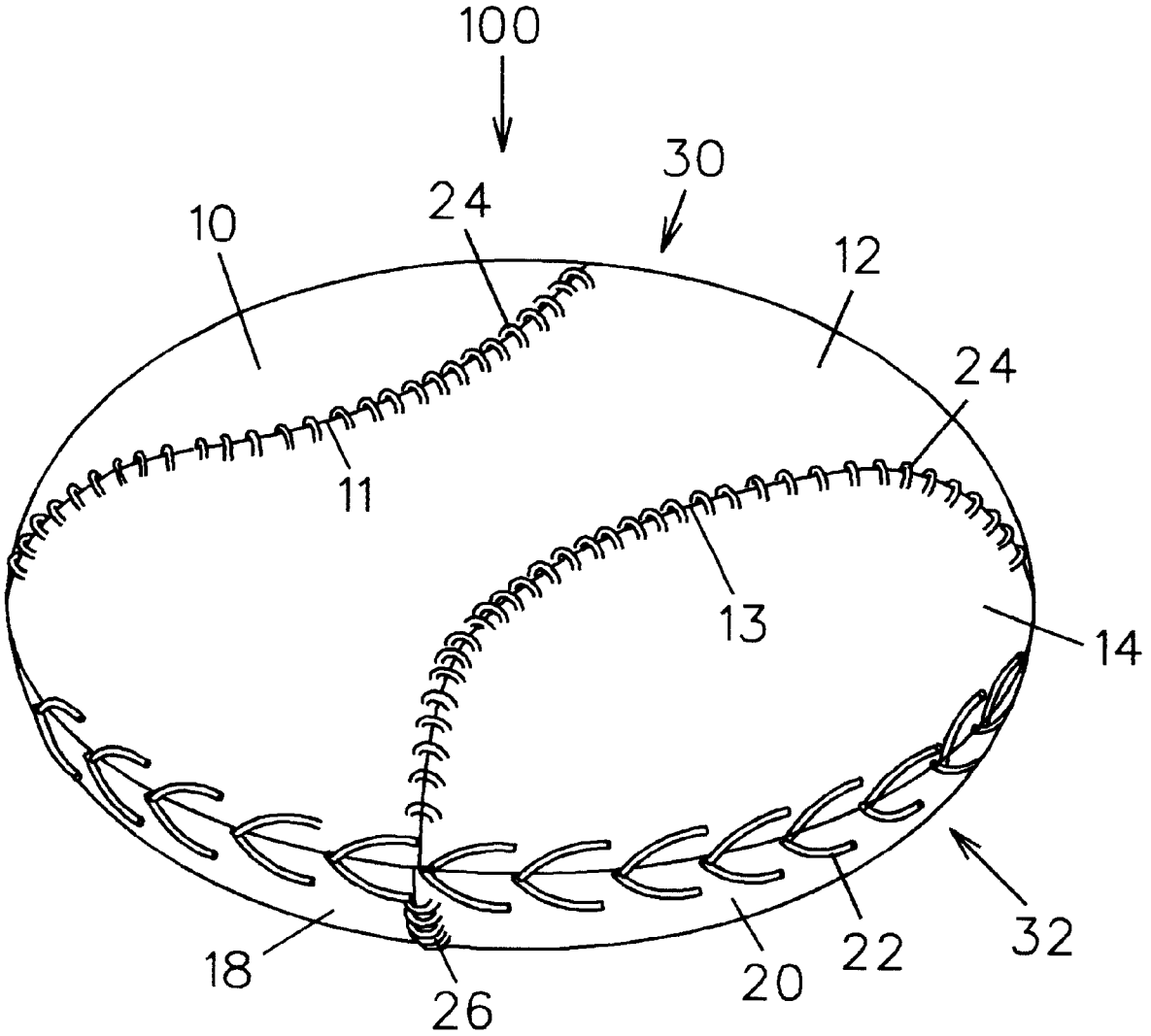
FIG. 1 is a full scale perspective view showing the multiple panels and lacing of the hand bag.
Figure 2:
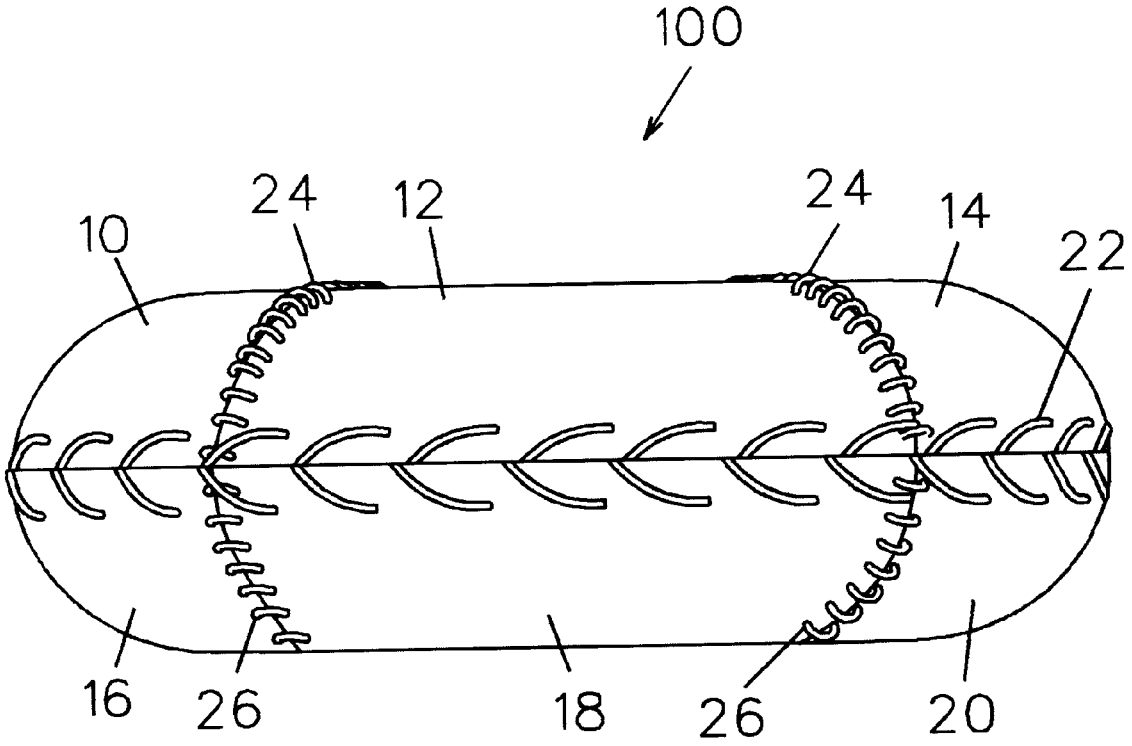
FIG. 2 is a full scale side view of the hand bag of FIG. 1.

Turning more particularly to the drawings, FIGS. 1 and 2 illustrate the hand bag 100 as generally comprising a primary upper panel 30 having congruent subpanels 10, 14 with an intermediate panel 12 therebetween. Hand bag 100 further includes a primary lower panel 32 with congruent subpanels 16 and 20 with intermediate subpanel 18 therebetween. The primary upper panel 30 is secured to the lower primary panel 32 by peripheral stitching 21 and protective exterior leather lacing 22. The juncture of each subpanel 10, 14 and 16, 20 with its intermediate subpanel 12 and 18 presents lines of flexion 11, 13, 17, 19 therebetween. Stitching 24, 26 either reinforces these lines of flexion or joins subpanels to the intermediate panel without degrading the flexion therebetween. The hand bag 100 is preferably approximately three inches along its longitudinal axis and one inch high along its central vertical axis when the hand bag is filled with the filler material 46. The panels 10, 12, 14, 16, 18, 20 are preferably constructed of a resilient/pliable material such as garment suede leather so as to provide a suitable durability, resilience and flexibility for prolonged game use. It is understood that although the preferred embodiment is illustrated having three upper panels identical in configuration to three lower panels, the device disclosed herein may have a plurality of upper and lower panels which may be positioned in asymmetric configurations.

Figure 3A:
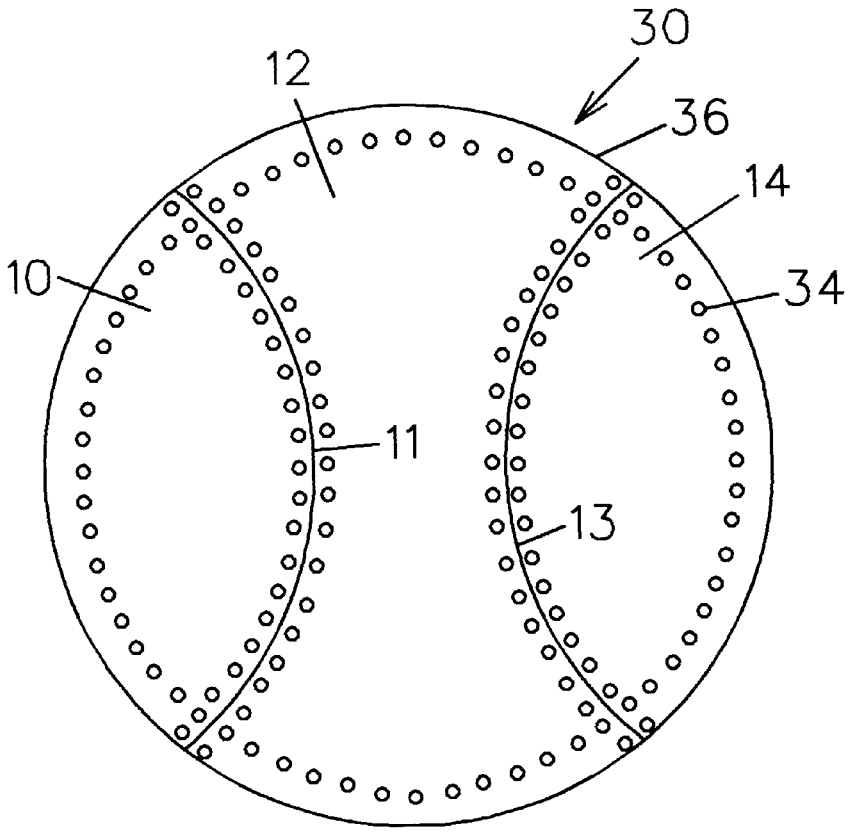
FIGS. 3A, 3B are full scale plan views showing the separated panels of the hand bag.
Figure 3B:
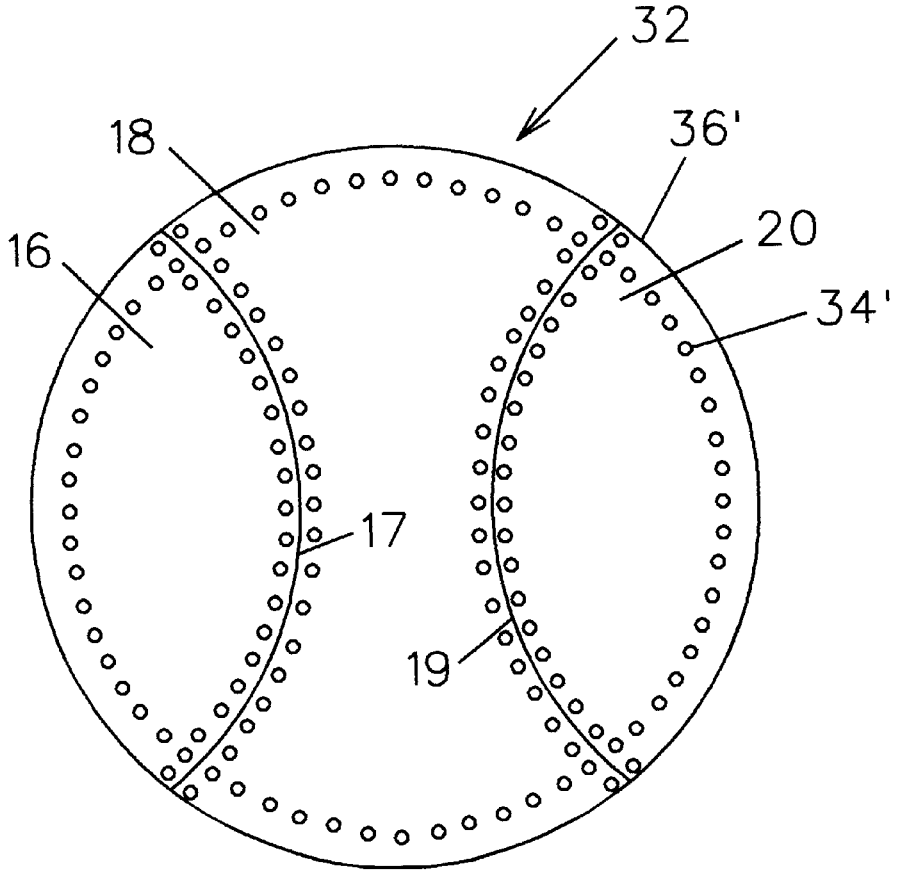
Figure 4:
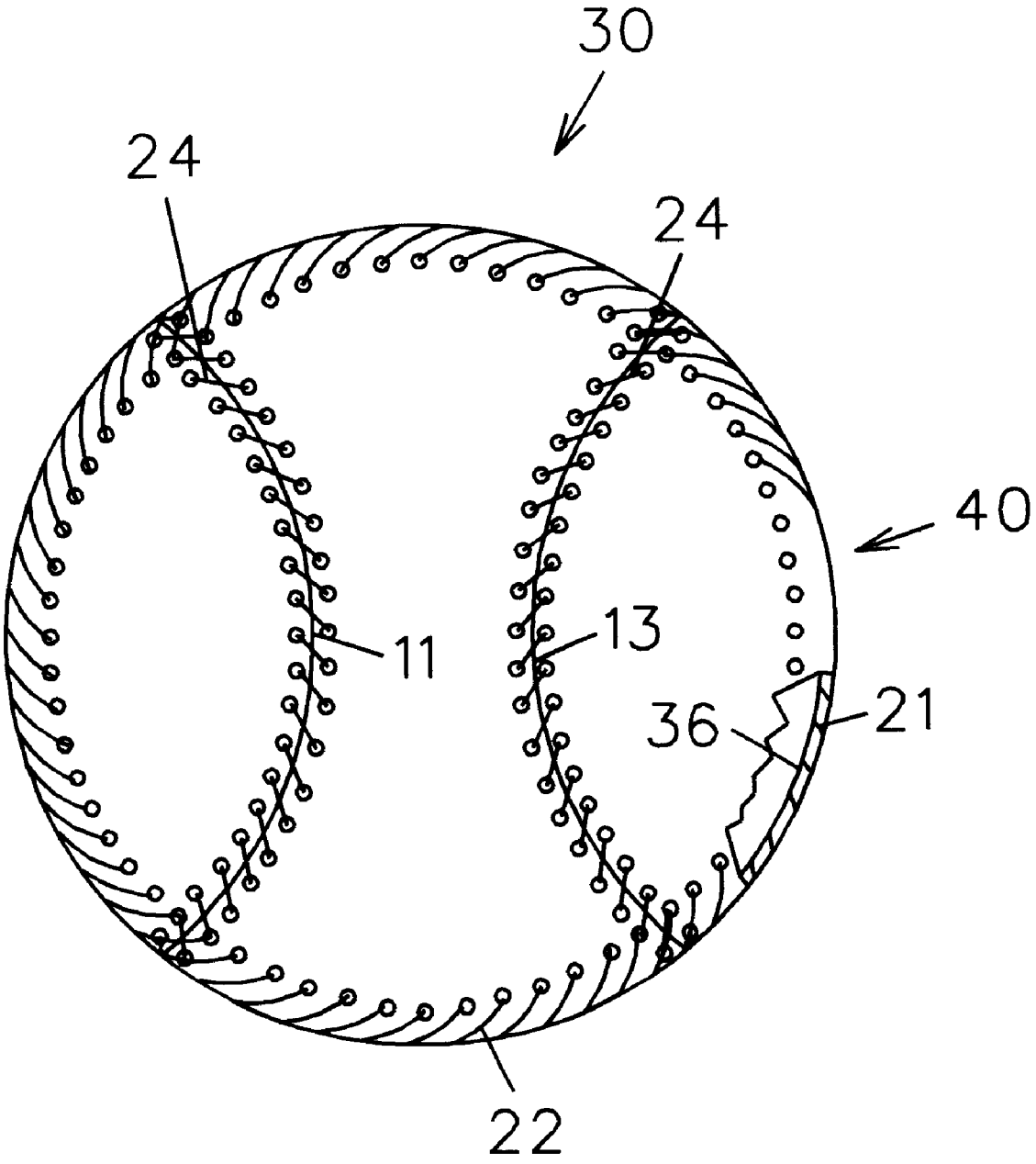
FIG. 4 is a full scale top view of the hand bag of FIG. 1.

Turning to FIGS. 3 and 4, the top panels 10, 12, 14 are stitched 24 together during assembly forming a single top panel 30 that is more flexible along the lines of flexion 11, 13. The bottom panels 16, 18, 20 are likewise stitched together forming a single bottom panel 32 that is more flexible along the lines of flexion 17, 19. The multiple subpanels, bendable along these lines of flexion, enhance the durability and integrity of the hand bag while providing more efficient contact with the back of the game player's hand. Each primary panel 30, 32 contains a plurality of inwardly displaced apertures 34, 34' about the circumference which are to receive the exterior lacing 22. The panels 30, 32 are aligned with the exterior surfaces facing one another. The peripheries 36, 36' of the panels 30, 32 are stitched together such that an opening 40 is left between the two panels 30, 32. Upon turning the joined panels 30, 32 inside out the sewn together peripheries 36, 36' are now on the interior of the bag.

Figure 5:
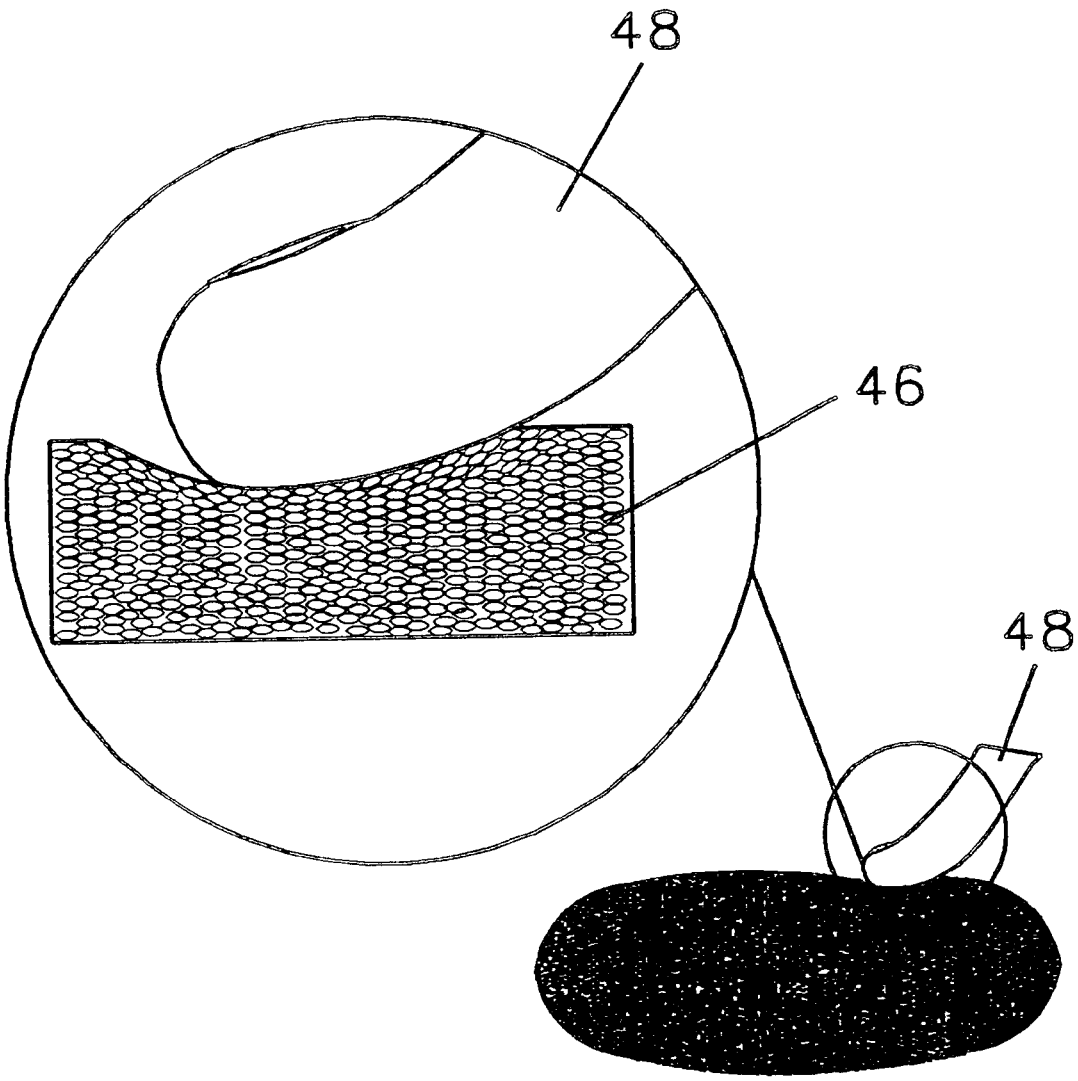
FIG. 5 is a front diagrammatic view with an enlargement showing the effect of pressure applied to the filler material within the hand bag.
Figure 6:
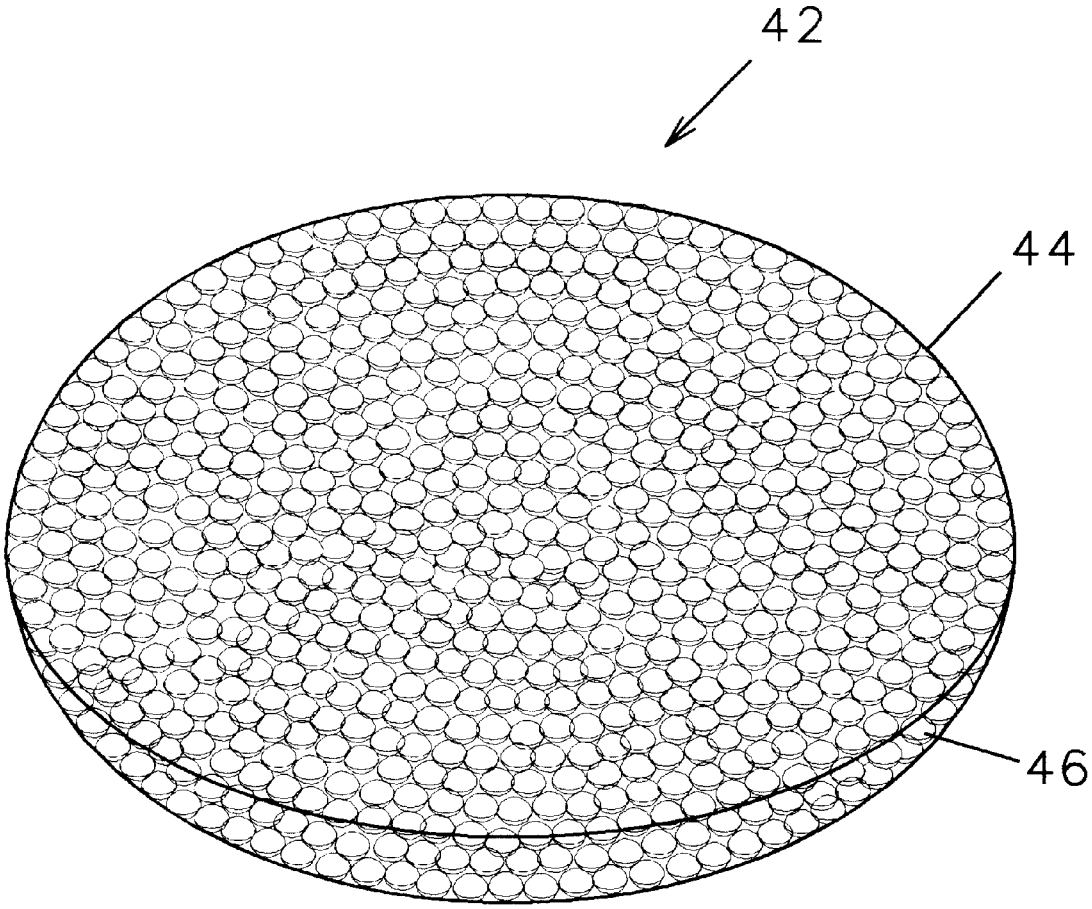
FIG. 6 is a perspective view showing the inner lining of the hand bag containing pelletized filler material.
Figure 7:
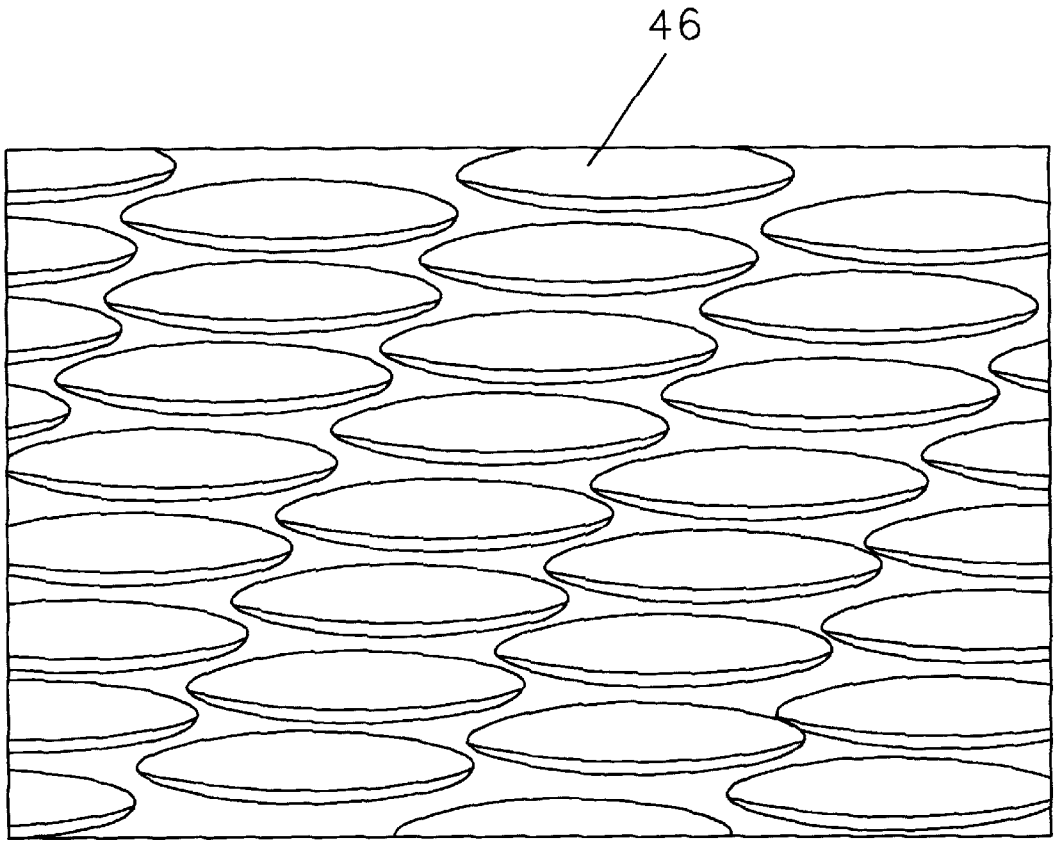
FIG. 7 is an enlarged perspective view showing pelletized filler material.

Turning to FIGS. 5, 6, and 7, a transparent inner lining 42 forms a pouch having filler material contained therein. The inner lining 42 is made of a material such as cellophane that is more flexible than the exterior panels. The inner lining 42 is either heat sealed or sewn along the center periphery of the lining 44 to provide a prepackaged filler for the hand bag. The preferred filler material comprises disk-shaped pellets 46 made of high density polyethylene (HDPE). Each pellet 46 is symmetrically convex about an imaginary longitudinal axis (FIG. 7) to present an ellipsoidal side view. The pellets, as so shaped, slide over the top of each other when impacted by another surface such as a finger 48 or the back of a hand. As viewed along a central cross section taken along the central longitudinal axis, an ellipsoid configuration of the resulting pellets 46 is now preferred such that the distance between the upper and lower surfaces of the ends of each pellet 46 is less than the distance between these surfaces at the center thereof. This is diagrammatically shown in FIG. 7, the pellet design sufficiently spacing the pellets one from the other so as to assure slidable movement therebetween. It is understood that the inner lining is not entirely filled with the pellets, thus allowing the pellets to freely slide over each other upon compression. In another embodiment, the inner lining 42 may contain a liquid or gel having fluidity attributes similar to the disk-shaped HDPE pellets.

After insertion of inner lining 42 and the pellets through the opening 40, one end of the lacing 22 is knotted and inserted through an aperture adjacent the opening 40. The lacing 22 is then passed through the adjoining apertures 34, 34' about the upper 30 and lower 32 panels until arriving at the opening 40 from the opposed side thereof. The free end of the lacing 22 is then knotted with the knot being placed on the interior of the hand bag 100 with the opening 40 being sewn shut. Accordingly, the hand bag 100 now presents a FIG. 1 configuration having a continuous protective lacing 22 intertwined around the previously sewn periphery of the hand bag 100. This lacing further secures the panels 10, 12, 14, 16, 18, 20 and protects the peripheral stitching from direct contact during game use so as to prolong hand bag 100 life.

As best shown in FIG. 1 this construction presents an upper and lower panels 30, 32 configured to present an area approximating/complementing the average area presented by the back of a player's hand. As the inner lining 42 of the hand bag 100 is not completely filled with pellets 46, the pellets 46 are free to slide over each other along the imaginary longitudinal (3") and vertical axes (1"). Thus, the struck panels 10, 12, 14, 16, 18, 20 of the hand bag 100 will deform when properly contacted by the back of the game player's hand. Such deformation, as assisted by the lines of flexion, allows the panels 10, 12, 14 or 16, 18, 20 adjacent to the back of the hand to depress and/or conform to the hand back while the opposing panels expand. Moreover, the use of lining 42 precludes pellets from rubbing against the inner surface of primary panels 30, 32 and abrasion thereof. As lining 42 is more flexible than the panels 30, 32, flexion of the panels is not inhibited. Also, the multiple panel configuration provides for depression of the specific panel being contacted by the game player's hand. During striking, the convex surfaces of the ellipsoid-shaped pellets 46 allow for a fluid-like movement within the confines of the panels 10, 12, 14, 16, 18, 20 as above described. Thus, improved fluidity of the pellets is provided which allows the hand bag 100 to readily change shape.

The above attributes cooperate in the provision of a proper lift to the hand bag upon a proper striking of the hand bag 100 with the back of the hand, such striking usually provided by a matching of the back of the hand with the surface of the panels.

In use, various games can be played involving either sole or multiple users with the purpose of the game to keep the hand bag 100 aloft by utilizing the back of the hand. In game playing involving multiple users the users may sit in a circle or around a table or the like so as to maintain game play while enjoying each other's company.

It is understood that various types of games may be utilized according to the game rules decided upon by the users. During such use the hand/eye coordination, balance and other attributes will be improved along with manual dexterity.

It is understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. An improved game bag comprising:

a pair of congruent upper and lower panels formed of a resilient material with each panel presenting a periphery, each of said panels further comprising:

first and second congruent subpanels with an intermediate subpanel therebetween;

a line of flexion between each of said subpanels and said intermediate subpanel, said lines of flexion providing a flexibility therealong greater than the flexibility of said resilient material of said upper and lower panels;

a first line of stitching for joining said panel peripheries in alignment to present a housing therebetween;

a second line of stitching along said lines of flexion in each subpanel;

a plurality of pellets disposed within said housing;

lacing extending about said stitched panel peripheries and across said first line of stitching for protecting said first line of stitching of said panel peripheries, a contact of an upper or lower panel of the hand bag with a back of a player's hand deforming at least one of said subpanels of said contacted upper or lower panels and flexing said at least one contacted subpanel along a respective line of flexion between said suboanels, said deforming causing an opposed subpanel on an noncontacted upper or lower panel to expand, whereby to impart an effective lift to said hand bag.

2. The game bag as claimed in claim 1 wherein each of said pellets are ellipsoid in configuration to present upper and lower surfaces of each pellet having a first smaller distance therebetween at first and second ends of each pellet relative to a second greater distance at a center of said pellet.

3. The game bag as claimed in claim 1 wherein said subpanels of each panel are congruent in configuration.

4. The game bag as claimed in claim 1 wherein said intermediate subpanels of each panel are congruent in configuration.

5. The game bag as claimed in claim 1 further comprising a liner of a resilient material within said housing with said pellets in said liner whereby to preclude said pellets from abrading an interior surface of said panels.

6. The game bag as claimed in claim 5 wherein said liner is joined to said panels.

7. The game bag as claimed in claim 5 wherein said resilient liner material is formed of a material having a resiliency greater than a resiliency of said material forming said panels to preclude said liner from interfering with flexing of said subpanels.

8. The game bag as claimed in claim 1 wherein each line of flexion has first and second opposed ends at said panel periphery.

9. An improved game bag comprising:

a pair of circular congruent upper and lower panels formed of a resilient material and each presenting a periphery, each of said panels further comprising:

first and second congruent subpanels with an intermediate subpanel therebetween;

a line of flexion between each of said subpanels and said intermediate subpanel, said lines of flexion providing a flexibility therealong greater than the flexibility of said resilient material of said upper and lower panels;

a line of stitching for joining said panel peripheries in alignment to present a housing therebetween;

a liner within said housing and joined to an interior surface of said panels forming said housing;

a plurality of pellets disposed within said liner in said housing, a contact of an upper or lower panel of the hand bag with a back of a player's hand deforming at least one of said subpanels of said contacted upper or lower panel and flexing said at least one contacted subpanel along said respective line of flexion between said subpanels, said deforming causing an opposed noncontacted subpanel to expand, whereby to impart an effective lift to said hand bag.

10. The game bag as claimed in claim 9 wherein each of said pellets are ellipsoid in configuration to present upper and lower surfaces of each pellet having a first smaller distance therebetween at first and second ends of each pellet relative to a second greater distance at a center of said pellet.

11. The game bag as claimed in claim 9 wherein said subpanels of each panel are congruent in configuration.

12. The game bag as claimed in claim 9 wherein said intermediate subpanels of each panel are congruent in configuration.

13. The game bag as claimed in claim 9 wherein said liner is formed of a material having a resiliency greater than a resiliency of said material forming said panels to preclude said liner from interfering with flexion of said subpanels.

14. An improved game bag comprising:

a pair of congruent upper and lower panels formed of a resilient material and each presenting a periphery, each of said panels further comprising:

a plurality of subpanels forming each panel;

a line of flexion between each of said subpanels, said lines of flexion provide a flexibility therealong greater than the flexibility of said resilient material of said upper and lower panels;

means for joining said panel peripheries in alignment to present a housing therebetween;

a filler material disposed within said housing;

a liner in said housing and disposed between said panels and said filler to preclude abrasion of said panels by said filler;

lacing extending about said joined panel peripheries for protecting said panel peripheries, a contact of an upper or lower panel of the hand bag with a back of a player's hand deforming at least one of said subpanels of said contacted upper or lower panels and flexing said at least one contacted subpanel along a respective line of flexion between said subpanels, said deforming causing an opposed subpanel of a noncontacted upper or lower panel to expand, whereby to impart an effective lift to said hand bag.

15. The game bag as claimed in claim 14 wherein said filler material comprises pellets ellipsoid in configuration presenting upper and lower surfaces of each pellet having a first smaller distance therebetween at first and second ends of each pellet relative to a second greater distance at a center of said pellet.

16. The game bag as claimed in claim 14 wherein said filler material comprises a fluid gel.

17. The game bag as claimed in claim 14 wherein said liner is joined to said panels.

18. The game bag as claimed in claim 14 wherein said liner is formed of a material having a resiliency greater than a resiliency of said material forming said panels to preclude said liner from interfering with flexion of said subpanels.

* * * * *

UNITED STATES PATENT AND TRADEMARK OFFICE

CERTIFICATE OF CORRECTION

PATENT NO. : 5,910,059

DATED : June 8, 1999

INVENTOR(S) : Thomas E. Hanson

It is certified that error appears in the above-identified patent and that said Letters Patent is hereby corrected as shown below:

Column 4, line 46, delete "suboanels" and substitute --subpanels--.

Signed and Sealed this

Thirtieth Day of November, 1999

*Attest:*

*Attesting Officer*

Q. TODD DICKINSON

*Acting Commissioner of Patents and Trademarks*